US005534904A

United States Patent [19]

Sheinman

[11] Patent Number: 5,534,904

[45] Date of Patent: Jul. 9, 1996

[54] MULTI-JET GENERATOR DEVICE FOR USE IN PRINTING

[75] Inventor: Yhoshua Sheinman, Tel Aviv, Israel

[73] Assignee: Meir Weksler, Mazkeret Batya, Israel

[21] Appl. No.: 336,749

[22] Filed: Nov. 7, 1994

[51] Int. Cl.[6] ..... B41J 2/02

[52] U.S. Cl. ..... 347/75; 347/20; 347/84

[58] Field of Search ..... 347/20, 44, 38, 347/40, 73, 75, 84, 85; 239/7, 11, 95, 97, 101, 581.1

[56] References Cited

U.S. PATENT DOCUMENTS

| | | | |
|---|---|---|---|
| 2,659,630 | 11/1953 | Angstadt | 239/11 |
| 3,739,393 | 6/1973 | Lyon et al. | 347/75 |
| 3,864,691 | 2/1975 | Schroeder | 346/74.2 |
| 4,287,522 | 9/1981 | Meyer | 347/95 |
| 4,303,924 | 12/1981 | Young, Jr. | 347/74 X |
| 4,578,686 | 3/1986 | Vollert | 347/72 |

FOREIGN PATENT DOCUMENTS

| | | | |
|---|---|---|---|
| 55-142661 | 11/1980 | Japan | 347/38 |

OTHER PUBLICATIONS

HEATH, J. S.; Centrifugal Ink Jet Printer; IBM Technical Disclosure Bulletin, vol. 21, No. 11; Apr. 1979 pp. 4668–4669.

*Primary Examiner*—John E. Barlow, Jr.
*Attorney, Agent, or Firm*—Mark M. Friedman

[57] ABSTRACT

A multi-jet generator device for creating droplets for use in a process for placing selected droplets of printing fluid onto a printing medium. The device includes a printing fluid distribution member for providing a supply of printing fluid, an array of jet generators deployed along the printing fluid distribution member and a drop generator rotatably deployed within the printing fluid distribution member for regulating the flow of the printing fluid from the printing fluid distribution member to the array of jet generators so as to control the breakage of jets of printing fluid into droplets. The resulting droplets can be charged and deflected so as to selectively impact a printing medium such as paper, glass or metal and complete the printing process.

30 Claims, 5 Drawing Sheets

MULTI-JET GENERATOR DEVICE FOR USE IN PRINTING

FIELD AND BACKGROUND OF THE INVENTION

The present invention relates to a multi-jet generator device useful in ink jet printers, such as those used as output devices for computers and the like, for printing, marking or plotting on various surfaces.

Ink jet printers employ various physical forces to take small quantities of ink from a reservoir, convert them into droplets, and transport the droplets through the air to the printing medium, such as paper, transparencies, metal, glass etc. The forces used to create and transport the droplets may be mechanical, electrostatic or thermal. Ink jet printers fall into two main categories—continuous-jet and drop-on-demand.

In both types of devices, droplets are formed by forcing a printing fluid, or ink, through a nozzle. Hence, the ink-jet devices typically include a multitude of very small diameter nozzles. Drop-on-demand systems typically use nozzles having openings ranging from 30 to 100 μm while Hertz continuous-jet systems typically use nozzles having openings ranging from only 10–20 μm.

The use of such nozzles leads to a number of difficulties, not the least of which is the relatively high incidence of nozzle clogging, high cost of manufacture, the requirement for tight tolerances and strict materials limitations. To avoid nozzle clogging and increase the reliability of such printers, high-grade fine filters must be used upstream of the nozzle to avoid dirt particles in the ink from reaching the nozzle. Furthermore, during the time the printer is not in use, the ink should not dry in the nozzle since a solid deposit will also result in clogging. To avoid this difficulty a humectant is used in the ink to prevent the ink from drying except when it contacts the paper. The ink must also contain fungicides to prevent biological growth which could result in nozzle clogging by fungi or bacteria. To obtain ink of a required color, a suitable dye must be added to the ink. Color pigments cannot be used since they clog the nozzle or the filter. The choice of dye is critical since the dye must not form a solid deposit with the humectant if the ink is allowed to dry in the nozzle.

All these strict requirements relating to the inks, severely limit the choice of inks which may be used in ink-jet systems using nozzles. Much research has been devoted to optimizing ink compositions in an attempt to find inks which have suitable characteristics. Typically, an ink found to be suitable represents a number of tradeoffs and compromises with respect to a series of properties.

There is thus a widely recognized need for, and it would be highly advantageous to have, an ink jet system which does not include the fine nozzles present in conventional systems and which would, therefore, be able to operate with a wide variety of ink composition without decreasing the reliability of the system.

SUMMARY OF THE INVENTION

The present invention successfully addresses the shortcomings of the presently known ink jet printer configurations by providing a multi-jet generator device and an ink-jet print engine incorporating such a device which does not incorporate small diameter nozzles and is therefore more reliable than comparable heretofore known devices. The absence of nozzles makes it possible to use a wide variety of printing fluids which were heretofore unusable in comparable devices featuring small diameter nozzles, such as UV-curable pigment containing inks.

The present invention discloses a novel device for generating droplets which can be used as part of an ink-jet printer. Rather than utilizing a series of small diameter nozzles, a multi-jet generator device according to the present invention includes a series of jet generators for providing a matrix of streams of printing fluid, each of which converges into a jet of printing fluid which, in turn, is broken into droplets in a controlled fashion. The droplets thus formed can be employed for non-contact printing in a manner similar to that used in conventional continuous ink jet printers.

Hence, according to a first aspect of the present invention, there is provided a multi-jet generator device for use in a process for placing selected droplets of printing fluid onto a printing medium, the device comprising: (a) a substantially horizontally printing fluid distribution member for providing a supply of printing fluid; (b) an array of jet generators deployed along the printing fluid distribution member, each of the jet generators having at least one channel with an inlet in flow communication with the printing fluid distribution member and an outlet deployed over the printing medium, each of the at least one channel providing a jet of printing fluid; and (c) a drop generator rotatably deployed within the printing fluid distribution member for regulating the flow of the printing fluid from the printing fluid distribution member to the array of jet generators so as to control the breakage of the jets into droplets.

According to a further feature of the present invention, each jet generator includes a set of disks having a front boundary disk, an intermediate disk and a rear boundary disk, wherein each set of disks defines a substantially vertical plane on which at least one jet of printing fluid is developed.

According to a still further feature of the present invention, the intermediate disk includes a plurality of discrete disk sections, each of the plurality of disk sections having a pair of end faces such that a pair of opposing end faces defines a channel.

According to a yet still further feature of the present invention, a front boundary disk of a first jet generator acts as a rear boundary disk of a second jet generator.

According to a yet still further feature of the present invention, each boundary disk includes a tip.

According to a yet still further feature of the present invention, the drop generator defines an interior volume associated with an ink supply and includes a series of generally radial bores such that the printing fluid can flow from the ink supply to the printing fluid distribution member via the drop generator.

According to a yet still further feature of the present invention, the drop generator has a gear-like cross section for providing regular fluid pressure pulses to printing fluid flowing from the printing fluid distribution member to the array of jet generators when driven at a uniform angular velocity.

According to a yet still further feature of the present invention, the regular fluid pressure pulses induce a synchronized breakage of jets into droplets.

According to a yet still further feature of the present invention, each channel is bulbous shaped having a narrow neck portion for controlling the issuance of its jet from its outlet.

According to a yet still further feature of the present invention, each jet is developed downstream of the jet generator at a virtual tip.

There is also provided according to a second aspect of the present invention, a system for placing printing fluid onto a printing medium, the system comprising: (a) a multi-drop generator device for creating droplets for use in a process for placing selected droplets of printing fluid onto a printing medium, the device including: (i) a substantially horizontally printing fluid distribution member for providing a supply of printing fluid, (ii) an array of jet generators deployed along the printing fluid distribution member, each of the jet generators having at least one channel with an inlet in flow communication with the printing fluid distribution member and an outlet deployed over the printing medium, each of the at least one channel providing a jet of printing fluid, and (iii) a drop generator rotatably deployed within the printing fluid distribution member for regulating the flow of the printing fluid from the printing fluid distribution member to the array of jet generators so as to control the breakage of the jets into droplets; (b) charging means for selectively imparting an electrical charge to the droplets; and (c) deflecting means for deflecting the selectively charged droplets.

According to a further feature of the present invention, each jet generator includes a set of disks having a front boundary disk, an intermediate disk and a rear boundary disk, wherein each set of disks defines a substantially vertical plane on which at least one jet of printing fluid is developed.

According to a still further feature of the present invention, the intermediate disk includes a plurality of discrete disk sections, each of the plurality of disk sections having a pair of end faces such that a pair of opposing end faces defines a channel.

According to a yet still further feature of the present invention, a front boundary disk of a first jet generator acts as a rear boundary disk of a second jet generator.

According to a yet still further feature of the present invention, each boundary disk includes a tip.

According to a yet still further feature of the present invention, the drop generator defines an interior volume associated with an ink supply and includes a series of generally radial bores such that the printing fluid can flow from the ink supply to the printing fluid distribution member via the drop generator.

According to a yet still further feature of the present invention, the drop generator has a gear-like cross section for providing regular fluid pressure pulses to printing fluid flowing from the printing fluid distribution member to the array of jet generators when driven at a uniform angular velocity.

According to a yet still further feature of the present invention, the regular fluid pressure pulses induce a synchronized breakage of jets into droplets.

According to a yet still further feature of the present invention, each channel is bulbous shaped having a narrow neck portion for controlling the issuance of its jet from its outlet.

According to a yet still further feature of the present invention, each jet is developed downstream of the jet generator at a virtual tip.

According to a yet still further feature of the present invention, the printing fluid is a UV-curable ink.

According to a yet still further feature of the present invention, the system further comprising intermediate means for curing the droplets of the UV-curable ink.

According to a yet still further feature of the present invention, the charging means includes an array of corona needles.

According to a yet still further feature of the present invention, the charging means includes an array of ion sources.

According to a yet still further feature of the present invention, the deflecting means includes electrostatically charged plates.

According to a yet still further feature of the present invention, the system comprising a staggered series of the systems for improved resolution.

According to a yet still further feature of the present invention, the system comprising a staggered series of the systems for printing with a plurality of colors.

According to a yet still further feature of the present invention, wherein a color is produced by contacting and causing to intermix on the printing medium two or more droplets of different colors which are still wet.

According to a yet still further feature of the present invention, wherein a color is produced by placing droplets of different colors in close proximity of each other on the printing medium so as to produce the perception of a new color.

There is also provided according to a third aspect of the present invention, a system for placing a printing fluid onto a printing medium, comprising: (a) a multi-drop generator device for creating droplets for use in a process for placing selected droplets of printing fluid onto a printing medium, the device including: (i) a substantially horizontally printing fluid distribution member for providing a supply of printing fluid, (ii) an array of jet generators deployed along the printing fluid distribution member, each of the jet generators having at least one channel with an inlet in flow communication with the printing fluid distribution member and an outlet deployed over the printing medium, each of the at least one channel providing a jet of printing fluid, and (iii) a drop generator rotatably deployed within the printing fluid distribution member for regulating the flow of the printing fluid from the printing fluid distribution member to the array of jet generators so as to control the breakage of the jets into droplets; (b) charging means for imparting an electrical charge to the printing fluid; and (c) selectively modulated deflecting means for deflecting the charged droplets.

BRIEF DESCRIPTION OF THE DRAWINGS

The invention is herein described, by way of example only, with reference to the accompanying drawings, wherein.

DESCRIPTION OF THE PREFERRED EMBODIMENTS

The present invention is of a multi-jet generator device for use in the context of ink jet printing. Specifically, the present invention is of a multi-jet generator device which does not utilize nozzles and which is capable of producing a synchronized matrix of droplets of printing fluid which can subsequently be used for printing, marking and/or plotting using a wide variety of printing fluids on a wide variety of printing media.

The principles and operation of a multi-jet generator device according to the present invention may be better understood with reference to the drawings and the accompanying description.

Figure 1:
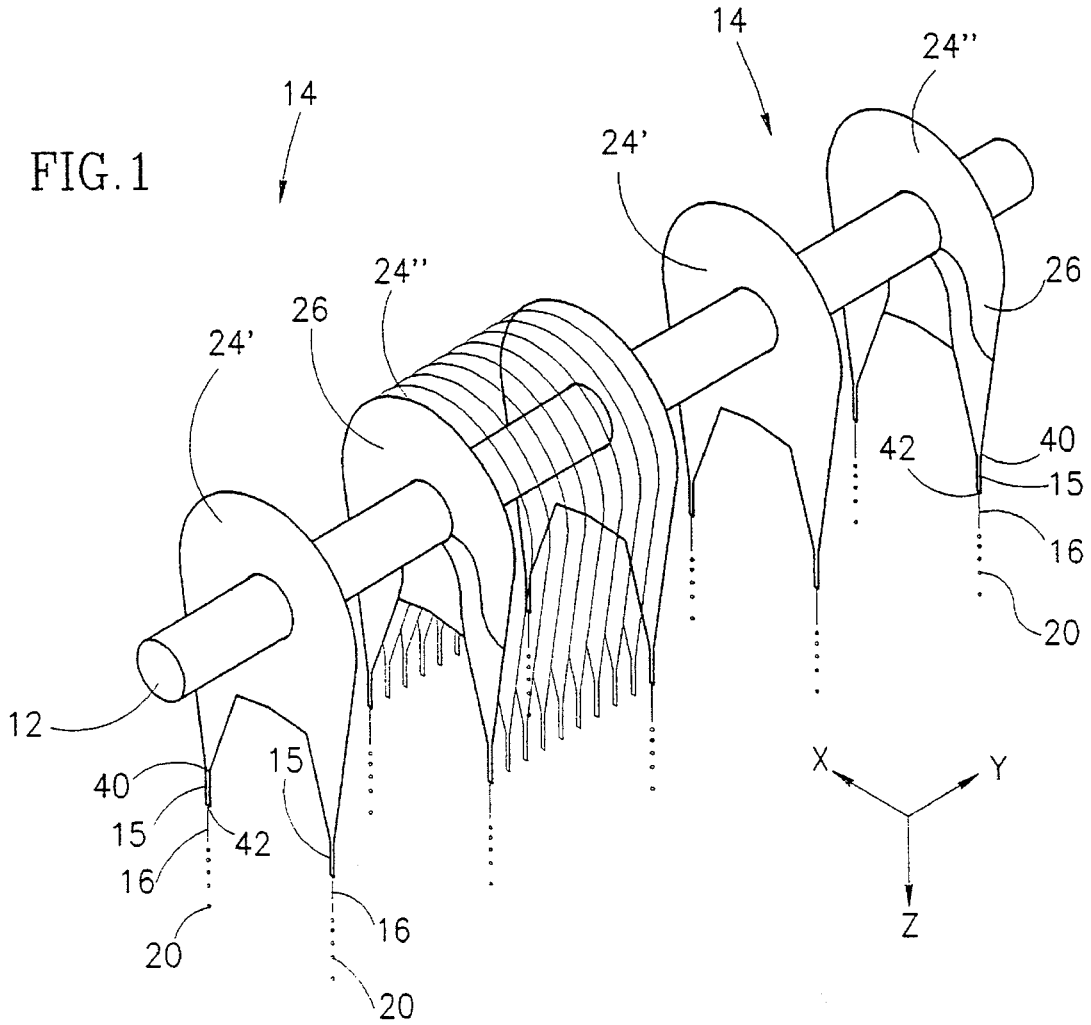
FIG. 1 is a schematic perspective illustration of a multi-jet generator device constructed and operative according to the present invention.
Figure 2:
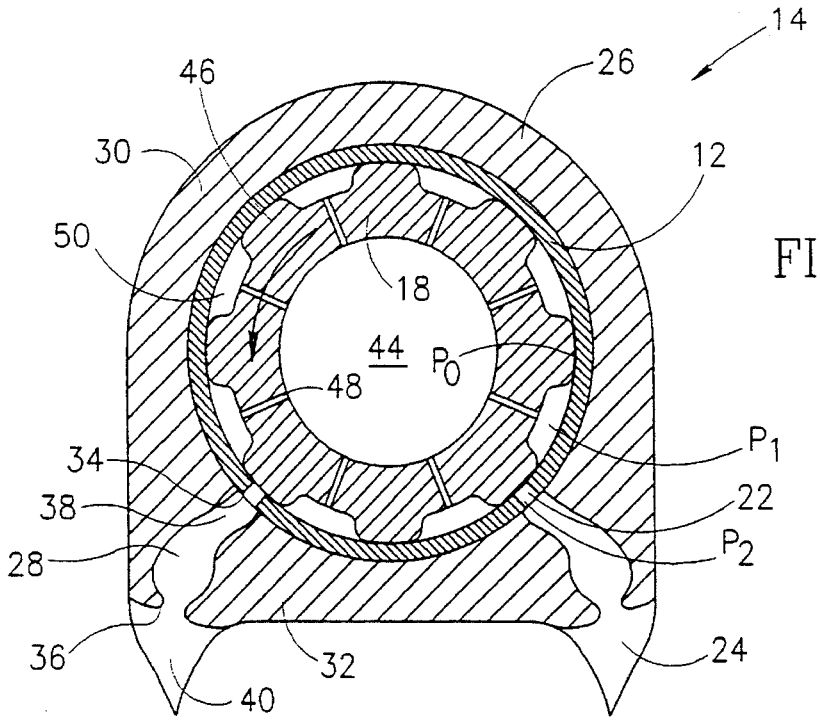
FIG. 2 is a schematic front view of a partially disassembled jet generator of the multi-jet generator device of FIG. 1.

Referring now to the drawings, FIGS. 1 and 2 illustrate a multi-jet generator device, generally designated 10, constructed and operative according to the teachings of the present invention. Generally speaking, multi-jet generator device 10 provides streams of printing fluid which converge into jets of printing fluid which, in turn, are broken up into droplets for treatment in any desired conventional manner, including their selective charging and deflection to, or away from, a printing medium. In the context of the present invention, the term "stream of printing fluid", hereinafter "stream", refers to a two-dimensional flow of printing fluid. And, in contrast, the term "jet of printing fluid", hereinafter "jet", refers to a uni-directional flow of printing fluid. For the sake of clarity, a Cartesian coordinate system is provided as shown.

Hence, multi-jet generator device 10 includes a substantially horizontal printing fluid distribution member 12 for providing printing fluid to an array of jet generators 14 deployed therealong in a substantially uniform manner in the y-direction. Each of jet generators 14 acts as a vertical plane on which one or more streams, in this case two streams 15, converge into vertical jets 16. Multi-jet generator device 10 further includes a drop generator 18 rotatably driven within printing fluid distribution member 12 for providing fluid pressure pulses to the flow of printing fluid from printing fluid distribution member 12 to jet generators 14 so as to control the breakage of jets 16 into a synchronized matrix of droplets 20.

Printing fluid distribution member 12 is configured as a pipe having a cylindrical cross-section and fabricated from any convenient material, for example, metal, plastic, and the like. Communication between the interior of printing fluid distribution member 12 and jet generators 14 is via a series of slots 22 running co-axial to the bottom edge of member 12. The number of slots 22 corresponds to the number of jets provided by each jet generator 14. This number of jets is preferably an even number for reasons to become apparent hereinbelow. In this case, slots 22 are equally disposed relative to the bottom edge of printing fluid distribution member 12. While, in the case that the number of jets is an odd number, then there is an additional slot running along the bottom edge of printing fluid distribution member 12. Slots 22 typically have a width in the order of 0.5 mm to 2 mm. Alternatively, slots 22 can be replaced by apertures.

Broadly speaking, each jet generator 14 includes a set of disks consisting of boundary disks 24 spaced by an intermediate disk 26 divided into a number of discrete disk sections. For the sake of clarity as clearly depicted in the first and last jet generators 14 in FIG. 1, boundary disks 24 of each jet generator 14 can be denoted as a front boundary disk 24' and a rear boundary disk 24". However, the front boundary disk 24' of a first jet generator is preferably used as the rear boundary disk 24" of an adjacent second jet generator such that the array of jet generators 14 is, in effect, a stack of alternate boundary disks 24 and intermediate disks 26.

Boundary disks 24 and the discrete disk sections of intermediate disks 26 are employed to define channels 28 between pairs of opposing end faces of disk sections. In the present instance, each intermediate disk 26 includes a first disk section 30 and a second disk section 32 providing two pairs of opposing faces for defining two channels 28. Each channel 28 has an inlet 34 in registration with one of slots 22 and an outlet 36 acting as the spout from which a stream 15 issues therefrom. Each channel 38 is bulbous shaped having an upper narrow neck portion 36.

Furthermore, boundary disks 24 are provided with tips 40. Hence, in the present instance, each boundary disk 24 is provided with two tips 40. It should be noted that the width of a stream 15 at tip 40 is greater than the width of tip 40 itself such that a tip 40 has a negligible effect on the flow of stream 15. However, it should also be noted that it is a particular feature of multi-jet generator device 10 that the onset of uni-directional z-direction flow of jets 16 and their subsequent breakage into droplets 20 occurs downstream of tips 40 and exterior to jet generators 14 in the region of a virtual tip 42 at a pre-determined distance downstream of tips 40.

Drop generator 18 is configured as a hollow gear shaft having an interior 44 for receiving a supply of printing fluid from an external source (not shown), teeth 46 extending substantially co-axial to printing fluid distribution member 12 and radial bores or slots 48 enabling flow communication between interior 44 and feeding volumes 50 defined between teeth 46. Hence, driving of drop generator 18 at a uniform angular velocity renders regular fluid pressure pulses as teeth 46 travel over inlets 34. Features of drop generator 18 which can be modified according to the particular application of a multi-jet generator device 10 include, but are not limited to, the number of teeth 46, the width of teeth 46, the clearance between teeth 46 and printing fluid distribution member 12, and the like. In particular, the clearance between teeth 46 and the interior diameter of printing fluid distribution member 12 is described by the following relationship $\epsilon > \kappa(Ls+Lr)$ where $\kappa$ is a constant with a value typically on the order of $\kappa=1.5$, Ls is the static boundary layer and Lr is the dynamic boundary layer.

All in all, a multi-jet generator device 10 is engineered so as to satisfy a number of operational parameters including the delivery rate of printing fluid, the number of jets 16 developed on each jet generator 14, the type of printing fluid, the type of printing medium, and the like. Specifications which determine the construction and operation of multi-jet generator device 10 include: First, that teeth 46 concurrently travel over each inlet 34 so as to synchronize the breakage of jets 16 into droplets 20. Second, that channels 28 are continuously filled with printing fluid such that jets 16 are continuous flows of printing fluid. Third, that the travel of teeth 46 over inlets 34 provides fluid pressure pulses of sufficient amplitude and duration so as to regulate the formation of droplets 20 as required for different applications. Fourth, that the shear stress field of the printing fluid being forced through inlets 34 as teeth 46 travel over inlets 34 is within the work envelope of the printing fluid. And fifth, that heat developed by the driving of drop generator 18 does not adversely affect the printing fluid.

Figure 3:
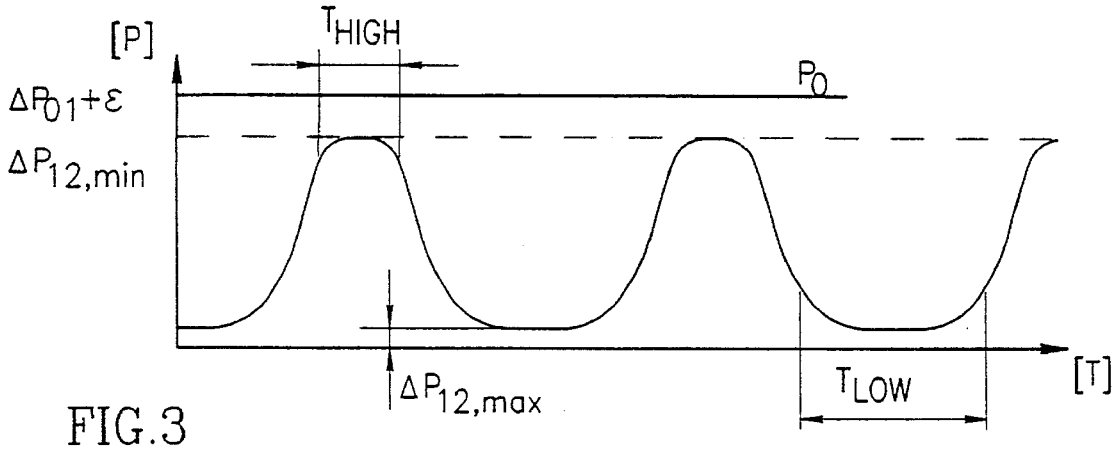
FIG. 3 is a graph depicting the pressure $P_2$ as a function of time.
Figure 4:
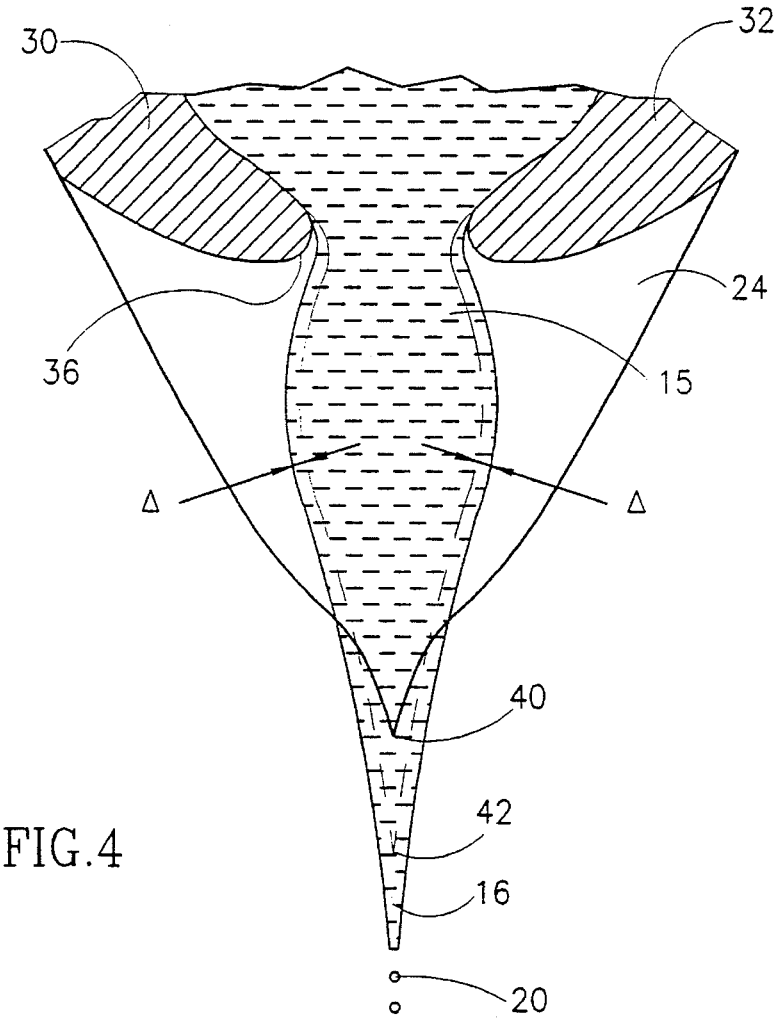
FIG. 4 is a close-up view of a stream of printing fluid converging into a jet of printing fluid before its break down into a series of droplets.

The operation of multi-jet generator device 10 for providing a synchronized matrix of droplets 20 is now described with further reference to FIGS. 3 and 4. A supply of printing fluid is provided to interior 44 of drop generator 18. The printing fluid flows into feeding volumes 50 via slots 48 and thereafter into channels 28. Letting the pressure inside interior 44 of drop generator 18 be $P_0$, the pressure inside printing fluid distribution member 12 be $P_1$ and the pressure at slots 22 be $P_2$, then $P_2$ can be described by the relationship:

$$P_2=P_0-\Delta P_{01}-\Delta P_{12}$$

Hence, when drop generator 18 is rotated with a constant angular speed ω, the pressure $P_2$ can be described by the following equation:

$$P_2=P_0-\Delta P_{01}-f_1\cdot\sin(wt)\cdot f_2(\epsilon,\mu,\gamma)$$

where μ and γ are the viscosity and kinematic density of the printing fluid, respectively, and $f_1$ is a function of the geometry of drop generator 18 according to the relationship:

$$f_1=f(Ts,a,b,h,R)$$

where Ts is the slot width, a is the length of the base of feeding volume 50, b is the length of teeth 46, h is the height of teeth 46 and R is the radius of drop generator 18 at the base of feeding volume 50. All in all, FIG. 3 depicts the manner in which pressure $P_2$ varies as a function of time for the case when h=a and b/a=2. Typically, the ink flows at a small velocity and the curve for the flow rate will be essentially identical to the graph of pressure $P_2$. Hence, the flow rate of streams 15 shows a cyclic variation at a frequency described by the equation:

$$f(P_2)=n\cdot\omega$$

where n is the number of teeth.

Streams 15 have a two dimensional flow along the x-direction and the z-direction within channels 28 by virtue of boundary plates 24. The x-direction component of the printing fluid flow causes streams 15 to diverge after their issuance from outlets 36. Typically, the z-direction component of the printing fluid flow is approximately 10 times the x-direction component of the printing fluid flow. The cyclic fluid pressure pulses cause a pulsation in stream 15. As streams 15 travel downward, steams 15 only converge to achieve uni-directional flow along the z-axis after their disengagement from tips 40 at virtual tip 42. Thereafter, jets 16 break into droplets 20 at a drop generation frequency equal to $f(P_2)$.

Figure 5A:
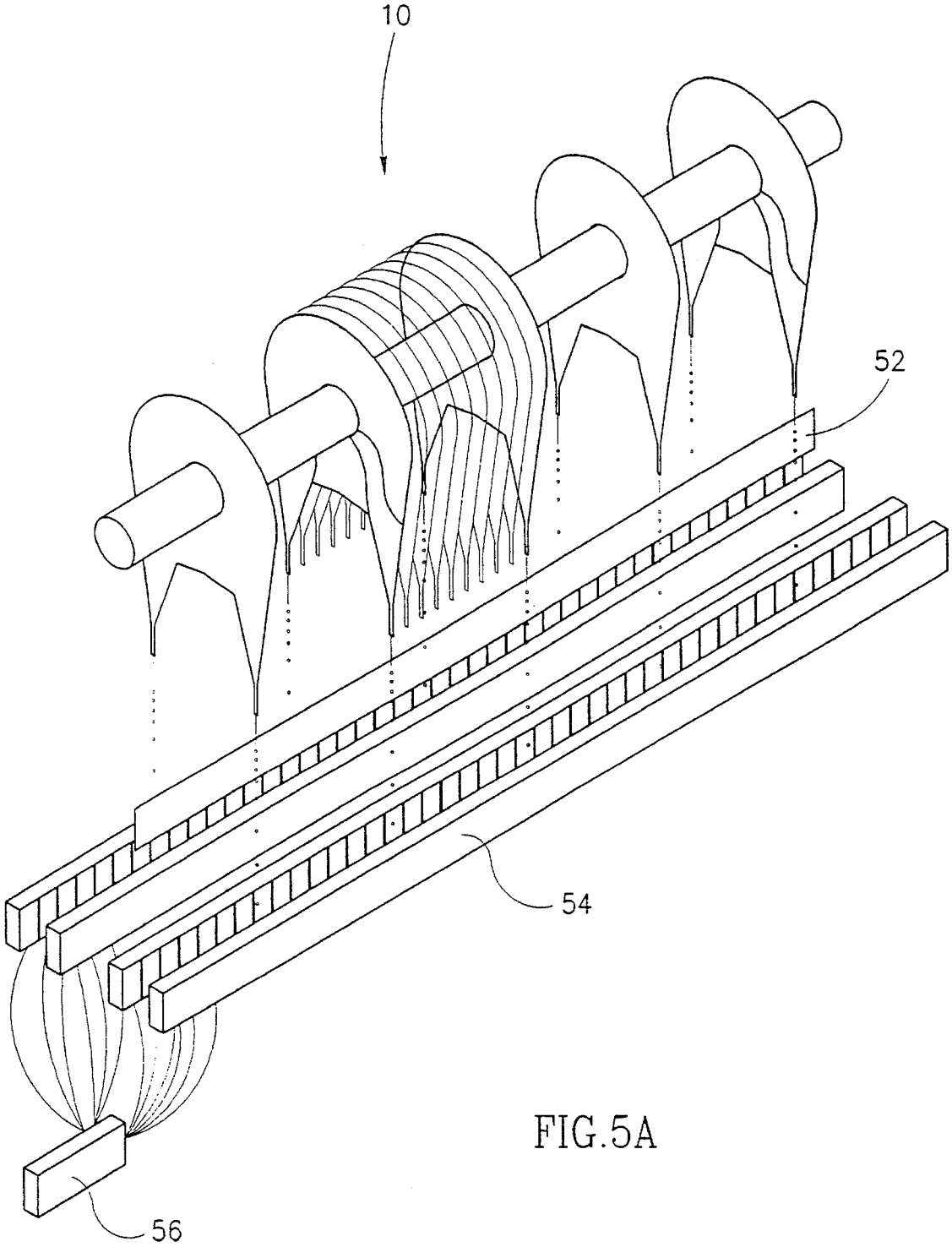
FIGS. 5*a* and 5*b* illustrate two alternative embodiments of charging and deflection apparatus useful with the multi-jet generator device of FIG. 1.
Figure 5B:
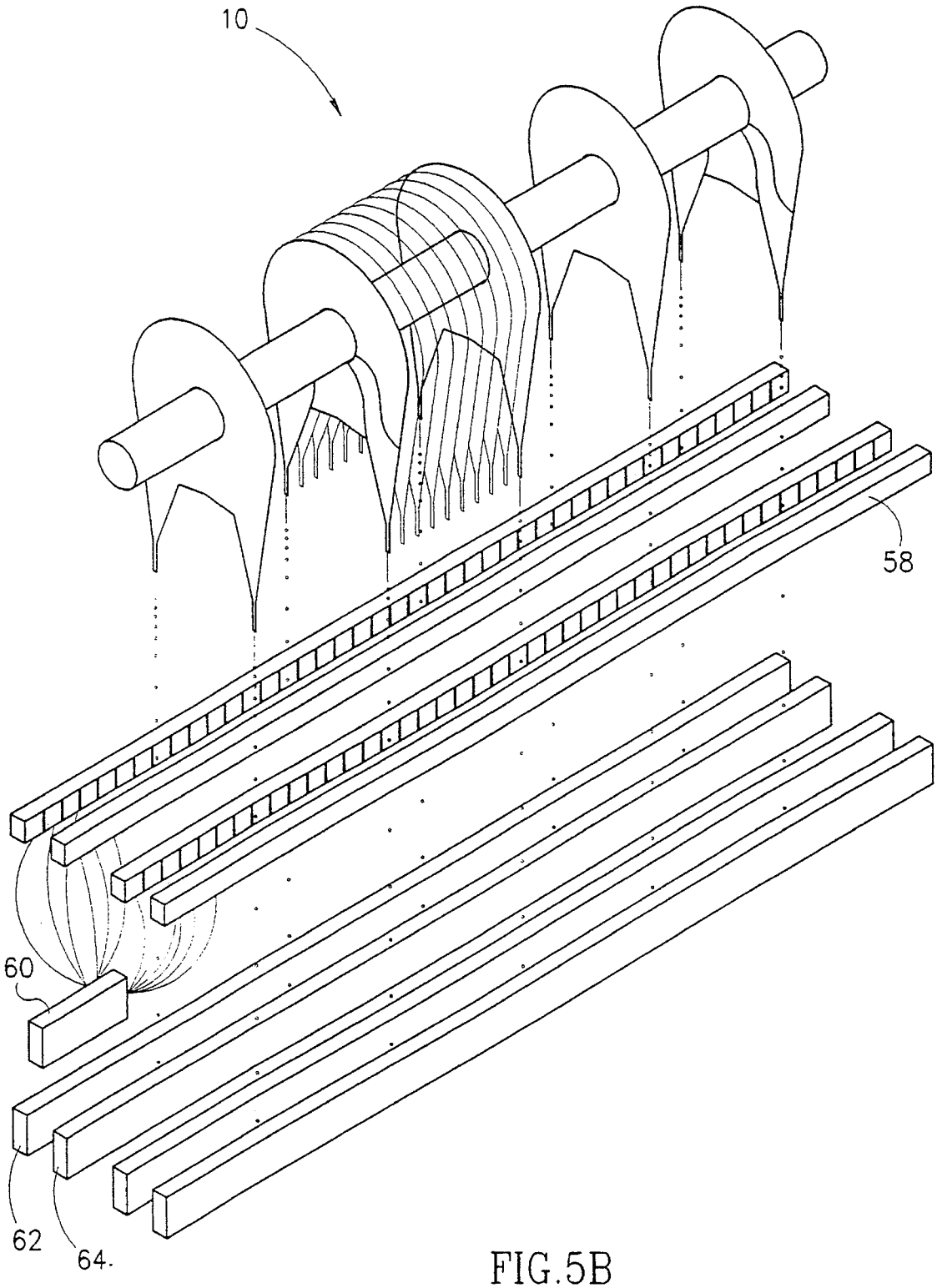

With reference now to FIGS. 5*a* and 5*b*, droplets 20 once formed can be handled using conventional techniques to direct them onto or away from a printing medium. Two techniques are well known in the art. According to the first technique, droplets 20 are charged in an information-wise manner and then electrostatically deflected. Such charging may take place with the aid of an array of corona needles, with an array of ion sources, and the like. In contrast according to the second technique, each droplet is charged and then either deflected or undeflected as required in an information-wise manner.

Reference is now made to FIG. 5*a* which illustrates a set-up in which all of droplets 20 are uniformly charged, such as passing through a region 52 containing a laterally uniform source of charges or alternatively by charging the ink prior to drop formation. In this case, information-wise deflection is achieved by an electric field which is separately determined for each droplet by an array of electrodes 54. The voltage on each electrode is controlled in an information-wise manner by a voltage controller 56 in response to an information input thereto.

Reference is now made to FIG. 5*b* which illustrates a set-up in which droplets are charged in an information-wise manner such as by an array of individually charging electrodes 58 which are controlled by a controller 60 in response to an information input thereto. In this case, deflection is produced by a uniform electric field which is produced by pairs of elongate electrodes 62 and 64 extending along multi-jet generator device 10.

Figure 6:
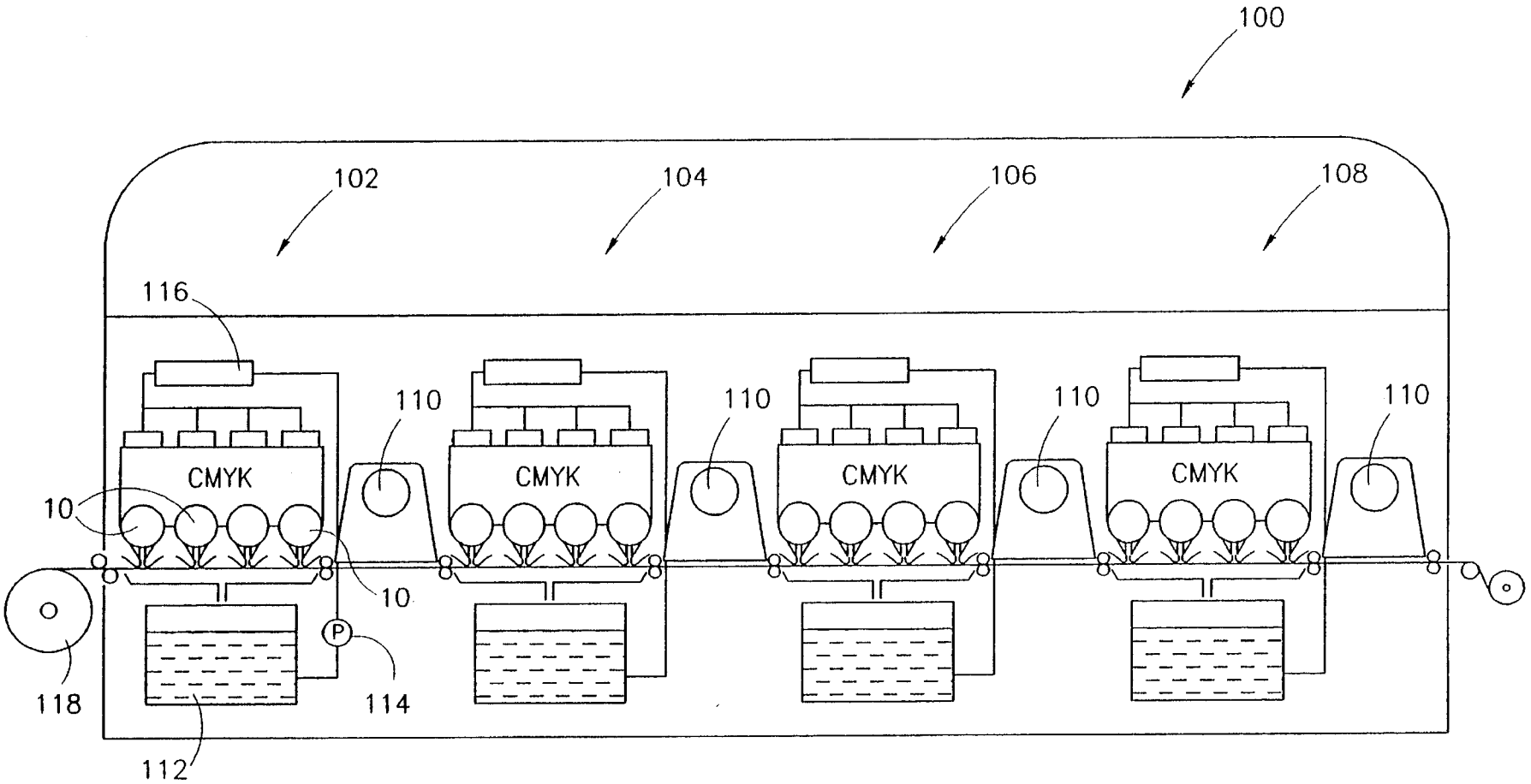
FIG. 6 is a schematic depiction of an entire printer system, incorporating the multi-jet generator device of FIG. 1.

With reference now to FIG. 6, a four color printing system, generally designated 100, includes four color heads 102, 104, 106 and 108 for the four CMYK colors, respectively. Typically each multi-jet generator device 10 can provide 50 dpi and therefore each color head, for example, color head 102, includes four staggered multi-jet generator devices 10 to effect high resolution single-pass color printing of 200 dpi. Between each color head 102, 104, 106 and 108, the printing medium may be treated in some desirable fashion. For example, when UV-curable ink is used, an UV lamp 110 may be located following each color head in order to fix the most recently used color. Furthermore, each color head 102, 104, 106 and 108 also features an ink reservoir 112. Ink is circulated by a pump 114 into a manifold 116 which feeds ink to each of multi-drop generator devices 10. The system also includes a printing medium feeder 118.

Printing system 100 can be used to print, mark and/or plot on various printing media, including paper, glass, plastic, metal and fabric. Printing system 100 is particularly suitable for large format printing by virtue of the static nature of the multi-get generator devices. Any suitable method of creating a variety of different colors can be used. One such scheme, which is particularly suitable for the UV-curable arrangement of FIG. 6, involves placing dots of different colors in the immediate vicinity of dots of different colors so as to form the visual perception in the mind of the viewer of a new color, much the way this is accomplished in half toning techniques.

All in all, printing system 100 integrating multi-jet generator devices of the present invention offers a number of advantages over conventional continuous ink jet technology. First, the multi-jet generator device according to the present invention includes few moving parts, is inherently reliable and trouble free, and is less expensive to build than conventional devices which require a multitude of precision-made nozzles. Second, the multi-jet generator device features little or no interaction between adjoining jets. And third, the multi-jet generator device is able to use a greatly enlarged group of printing fluids, including photo-polymers (such as UV-curable ink) which are shear-sensitive and cannot normally be passed through small diameter nozzles without polymerizing or otherwise degrading. Furthermore, feed of printing fluids is considerably simplified.

While the invention has been described with respect to one preferred embodiment, it will be appreciated that many variations, modifications and other applications of the invention may be made.

What is claimed is:

1. A multi-jet generator device for use in a process for placing selected droplets of printing fluid onto a printing medium, the device comprising:

(a) a substantially horizontally printing fluid distribution member for providing a supply of printing fluid;

(b) an array of jet generators deployed along said printing fluid distribution member, each of said jet generators having at least one channel with an inlet in flow communication with said printing fluid distribution member and an outlet deployed over the printing medium, each of said at least one channel providing a jet of printing fluid; and (c) a drop generator rotatably deployed within said printing fluid distribution member for regulating the flow of the printing fluid from said printing fluid distribution member to said array of jet generators so as to control the breakage of each said jet into droplets.

2. The device as in claim 1, wherein each of said jet generators includes a set of disks having a front boundary disk, an intermediate disk and a rear boundary disk, wherein each set of disks defines a substantially vertical plane on which at least one jet of printing fluid is developed.

3. The device as in claim 2, wherein said intermediate disk includes a plurality of discrete disk sections, each of said plurality of discrete disk sections having a pair of end faces such that a pair of opposing end faces defines a channel.

4. The device as in claim 2, wherein a front boundary disk of a first jet generator acts as a rear boundary disk of a second jet generator.

5. The device as in claim 2, wherein each said front boundary disk and said rear boundary disk includes a tip.

6. The device as in claim 1, wherein said drop generator defines an interior volume associated with an ink supply and includes a series of generally radial bores such that the printing fluid can flow from said ink supply to said printing fluid distribution member via said drop generator.

7. The device as in claim 1, wherein said drop generator has a gear-like cross section for providing regular fluid pressure pulses to printing fluid flowing from said printing fluid distribution member to said array of jet generators when driven at a uniform angular velocity.

8. The device as in claim 7, wherein said regular fluid pressure pulses induce a synchronized breakage of said jets into droplets.

9. The device as in claim 1, wherein each channel is bulbous shaped having a narrow neck portion for controlling the issuance of said jet from said outlet.

10. The device as in claim 1, wherein each jet is developed downstream of said jet generator at a virtual tip.

11. A system for placing printing fluid onto a printing medium, the system comprising:

(a) a multi-drop generator device for creating droplets for use in a process for placing selected droplets of printing fluid onto a printing medium, the device including:

(i) a substantially horizontally printing fluid distribution member for providing a supply of printing fluid, (ii) an array of jet generators deployed along said printing fluid distribution member, each of said jet generators having at least one channel with an inlet in flow communication with said printing fluid distribution member and an outlet deployed over the printing medium, each of said at least one channel providing a jet of printing fluid, and (iii) a drop generator rotatably deployed within said printing fluid distribution member for regulating the flow of the printing fluid from said printing fluid distribution member to said array of jet generators so as to control the breakage of each said jets into droplets;

(b) charging means for selectively imparting an electrical charge to said droplets; and (c) deflecting means for deflecting said selectively charged droplets.

12. The system as in claim 11, wherein each of said jet generators includes a set of disks having a front boundary disk, an intermediate disk and a rear boundary disk, wherein each set of disks defines a substantially vertical plane on which at least one jet of printing fluid is developed.

13. The system as in claim 12, wherein said intermediate disk includes a plurality of discrete disk sections wherein opposing faces of said discrete disk sections define said channels.

14. The system as in claim 12, wherein a front boundary disk of a first jet generator acts as a rear boundary disk of a second jet generator.

15. The system as in claim 12, wherein each said front boundary disk and said rear boundary disk includes a tip.

16. The system as in claim 11, wherein said drop generator defines an interior volume associated with an ink supply and includes a series of generally radial bores such that the printing fluid can flow from said ink supply to said printing fluid distribution member via said drop generator.

17. The system as in claim 11, wherein said drop generator has a gear-like cross section for providing regular fluid pressure pulses to printing fluid flowing from said printing fluid distribution member to said array of jet generators when driven at a uniform angular velocity.

18. The system as in claim 11, wherein said regular fluid pressure pulses induce a synchronized breakage of said jets into droplets.

19. The system as in claim 11, wherein each of said at least one channel is bulbous shaped having a narrow neck portion for controlling the issuance of said jet from said outlet.

20. The system as in claim 11, wherein each jet is developed downstream of said jet generator at a virtual tip.

21. The system as in claim 11, wherein the printing fluid is a UV-curable ink.

22. The system as in claim 21, further comprising intermediate means for curing the droplets of said UV-curable ink.

23. The system as in claim 11, wherein said charging means includes an array of corona needles.

24. The system as in claim 11, wherein said charging means includes an array of ion sources.

25. The system as in claim 11, wherein said deflecting means includes electrostatically charged plates.

26. The system as in claim 11, comprising a staggered series of said systems for improved resolution.

27. The system as in claim 11, comprising a staggered series of said systems for printing with a plurality of colors.

28. The system as in claim 27, wherein a color is produced by contacting and causing to intermix on the printing medium two or more droplets of different colors which are still wet.

29. The system as in claim 27, wherein a color is produced by placing droplets of different colors in close proximity of each other on the printing medium so as to produce the perception of a new color.

30. A system for placing a printing fluid onto a printing medium, comprising:

(a) a multi-drop generator device for creating droplets for use in a process for placing selected droplets of printing fluid onto a printing medium, the device including:

(i) a substantially horizontally printing fluid distribution member for providing a supply of printing fluid, (ii) an array of jet generators deployed along said printing fluid distribution member, each of said jet generators having at least one channel with an inlet in flow communication with said printing fluid distribution member and an outlet deployed over the printing medium, each of said at least one channel providing a jet of printing fluid, and (iii) a drop generator rotatably deployed within said printing fluid distribution member for regulating the flow of the printing fluid from said printing fluid distribution member to said array of jet generators so as to control the breakage of each said jet into droplets;

(b) charging means for imparting an electrical charge to the printing fluid; and (c) selectively modulated deflecting means for deflecting said charged droplets.

* * * * *